United States Patent [19]

Gallo, Sr.

[11] Patent Number: 4,603,797

[45] Date of Patent: Aug. 5, 1986

[54] BOW WINDER

[76] Inventor: Joseph S. Gallo, Sr., 58 Peach St., Walpole, Mass. 02081

[21] Appl. No.: 812,276

[22] Filed: Dec. 23, 1985

[51] Int. Cl.[4] ..... A41H 43/00

[52] U.S. Cl. ..... 223/46

[58] Field of Search ..... 223/46; 28/147

[56] References Cited

U.S. PATENT DOCUMENTS

| | | | |
|---|---|---|---|
| 2,521,863 | 9/1950 | Mertz | 223/46 |
| 2,691,469 | 10/1954 | Willig et al. | 223/46 |
| 2,905,368 | 9/1959 | Runyan | 223/46 |
| 2,909,308 | 10/1959 | Darata | 223/46 |
| 3,097,771 | 7/1963 | Kerrigan et al. | 223/46 |
| 3,501,071 | 3/1970 | Zadosko | 223/46 |

*Primary Examiner*—Louis K. Rimrodt

[57] ABSTRACT

Apparatus for winding bows from ribbon comprising a base and arms about which the ribbon may be wound in a plurality of loops. One arm is rotatably supported on the base so that it is capable of rotation towards the other arm. A spring resists rotation of that arm towards the fixed arm. The rotatable arm and spring permit one arm to rotate towards the other when loops of ribbon are drawn together midway between the arms in forming a bow. A holding arm is provided overhead the loops of ribbon for holding a loop in an upright orientation.

19 Claims, 14 Drawing Figures

FIG 1
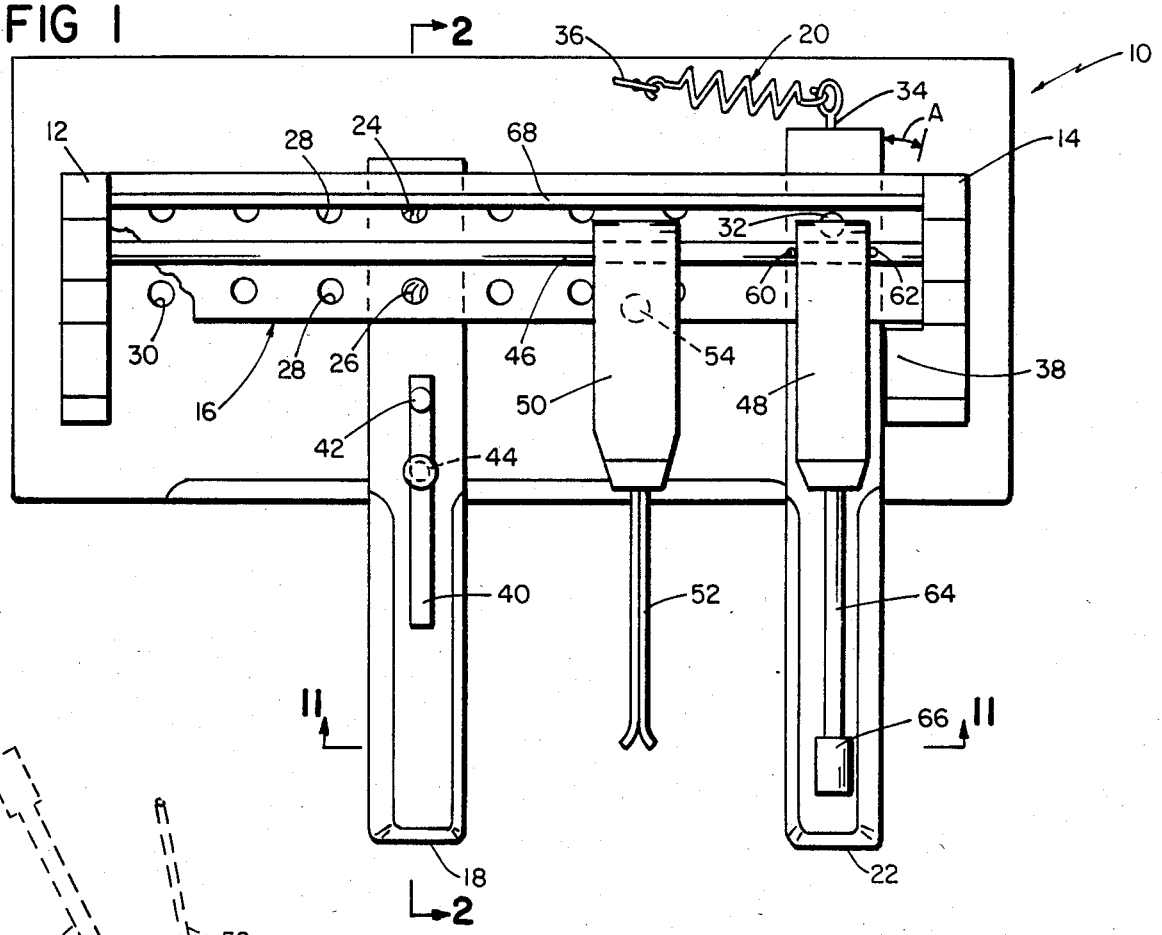
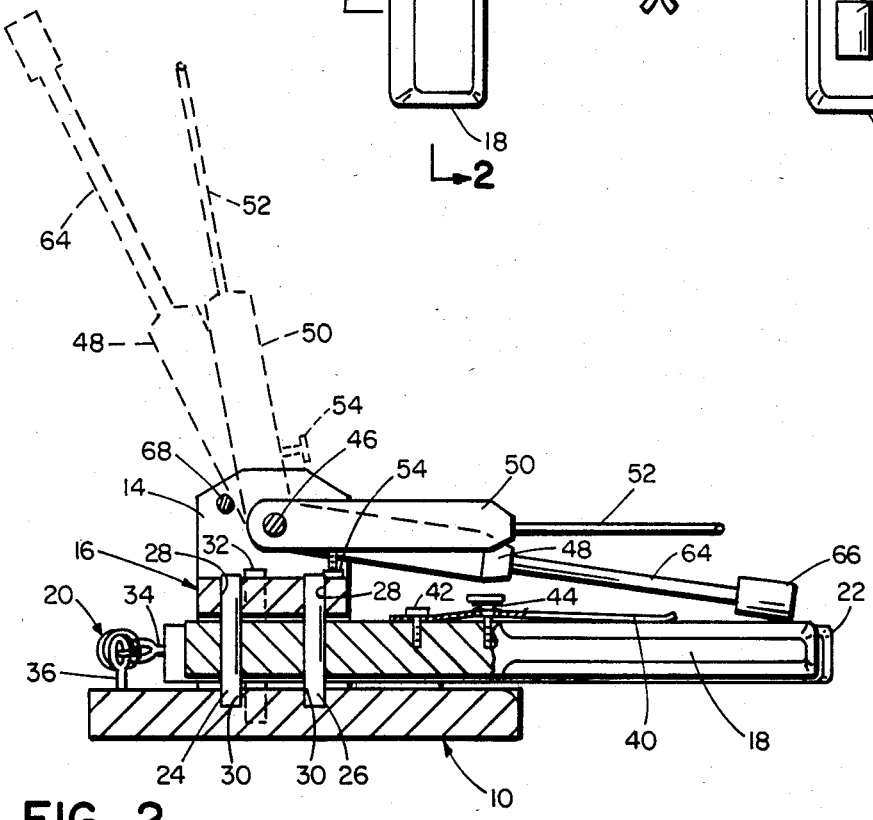
FIG 2
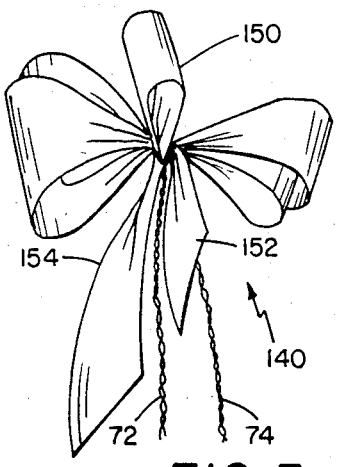
FIG 3
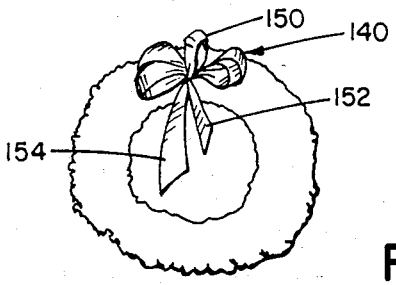
FIG 4

BOW WINDER

BACKGROUND OF THE INVENTION

This invention relates to apparatus for use by florists in the preparation of bows for use in floral arrangements and wreaths.

Bows are often used during festive and other seasons to enhance the beauty of wreaths, floral arrangements, and gifts. Such bows are generally made by hand by tying knots in a ribbon, or by binding the ribbon with wires. Some bows are stapled or glued together. The 3M Company supplies an automatic bow winding machine that cuts notches in the ribbon.

SUMMARY OF THE INVENTION

In a first aspect, the invention features an apparatus for winding bows from a ribbon comprising a base, a first and second arm, about which the ribbon may be wound in a plurality of loops, the arms being supported on the base. The apparatus further features a rotatable joint for supporting the second arm on the base so that it is capable of rotation towards the first arm. Also provided is a spring means for resisting the rotation of the second arm towards the first arm. The rotatable joint and spring means are capable of permitting the second arm to rotate towards the first arm sufficiently to allow the loops of the ribbon to be drawn together midway between the arms in forming a bow. In preferred embodiments, a spring tension clip is provided on the surface of one arm for holding an end of the ribbon; a weight arm supported on the base is capable of movement downwardly onto the top of one arm after the loops have been wound to hold an end of the ribbon in place; a means is provided for rotatably supporting the weight arm so that the arm may be rotated out of the proximity of the loops of ribbon when not needed; the first arm is supported on the base so as to be incapable of rotation; a means is provided to support at least one of the arms at a plurality of positions along the base so that the separation between the arms, and thereby the width of the loops, may be varied.

In a second aspect, the invention features a holding arm supported on the base so as to be capable of movement into position overhead the loops of ribbon. The holding arm provides a means for holding a loop of ribbon in an upright orientation over the loops wound around the main arms of the apparatus. In preferred embodiments, the holding arm is supported on the base so as to be capable of movement into position midway between the first and second arms and immediately above the midpoint of the loop, so as to hold a loop of ribbon in a position where it can be secured at the midpoint of the loops wound around the arms; a means is provided for holding a loop of the ribbon in a pair of calipers extending transversely to the ribbon, with the calipers being adapted to receive a loop of ribbon by sliding the loop between the calipers; and a means is provided for rotatably supporting the holding arm so that the arm may be rotated out of the proximity of the loops of ribbon.

In a third aspect, the invention features a method of winding a bow from ribbon comprising the steps of winding the ribbon around a pair of arms to form a plurality of wound loops of ribbon, cutting the ribbon at a distance from the wound loops to form a free end of ribbon, folding a portion of the free end of the ribbon back onto itself to form a first (or finger) loop, inserting the first loop into a holder positioned between the arms above the wound loops, thereby forming a second loop from the remainder of the free end not a part of the first loop, securing the first loop and wound loops together, and cutting the second loop to form two free ends of ribbon which extend from the finished bow. In preferred embodiments, loops are secured by twisting at least one wire around them, preferably one wire around each side of the first loop.

The invention has numerous advantages. Bows can be easily and quickly prepared by one person and can be of any desired size or design. Bows with different width ribbon and different width loops can be easily prepared. The apparatus for making the bows is simple and relatively inexpensive to manufacture. Bows with or without tails, and with tails of any length may quickly and easily be prepared. Bows can be constructed having the sheen side of the ribbon always facing outwards. Wires can be used to bind the bows together, and these permit the ready attachment of the bow to other items such as flower bouquets, wreaths, or to festive trees and presents. Attractive and uniform-appearing bows can be easily produced by relatively unskilled persons.

Other features and advantages of the invention will be apparent from the following description of the preferred embodiment and from the claims.

DESCRIPTION OF THE PREFERRED EMBODIMENT

The figures will first briefly be described.

DRAWINGS

FIG. 1 is a plan view of the presently preferred embodiment of the invention.

FIG. 2 is a cross-sectional view of said embodiment at 2—2 of FIG. 1.

FIG. 3 is a perspective view of a bow prepared using said embodiment (fewer loops than would ordinarily be preferred are shown for clarity).

FIG. 4 is a perspective view of a Christmas wreath with the bow of FIG. 3 attached.

STRUCTURE

Figure 5:
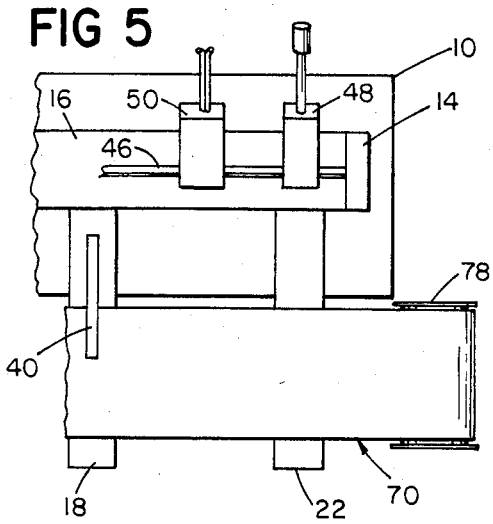
FIGS. 5–14 are diagrammatic views of said embodiment at various stages of making a bow (fewer loops than would ordinarily be preferred are shown for clarity).

Referring to FIGS. 1 and 2, the apparatus of the invention comprises base 10 to which two vertical supports 12 and 14 are fixedly attached. These supports are further fixedly attached to horizontal bar 16, approximately 30 cm in length. Between base 10 and bar 16 are placed two arms 18 and 22. Arm 18 can be moved horizontally between base 10 and bar 16, and fixedly attached between them, using two pins 24 and 26, which are positioned through holes 28 in horizontal bar 16 and corresponding holes in base 10 (see FIG. 2, hole 30). The distance between arms 18 and 22 is chosen dependent upon the width of the ribbon being used and the size of the bow required.

Arm 22 is fixedly attached to base 10 and horizontal bar 16 by a single pin 32 about which the arm may rotate. Arm 22 is positioned at a distance A (approximately 2 cm) from vertical support 14 so that the arm may rotate a limited distance about pin 32. Tension spring 20, connected between the back end of arm 22 and base 10, resists rotation of arm 22 toward arm 18, to maintain ribbon tension during use. A stop member 38, positioned between arm 22 and vertical support 14, ordinarily maintains arm 22 parallel to arm 18.

Arm 18 carries a clip 40 attached to the arm 18 by screw 42 and held in tension on the arm by spring-loaded screw 44. This clip serves to hold a ribbon inserted beneath it.

The apparatus includes rod 46, supported at each end by supports 12 and 14, and passing-through weight arm 48 and holding arm 50. Both arms 48 and 50 are supported on rod 46 so that they may rotate about its axis. Holding arm 50 can be readily moved along rod 46 and comprises a pair of metal calipers 52 through which a ribbon can be inserted and temporarily held. Beneath holding arm 50 is a screw 54, the head of which rests on horizontal bar 16, and which can be adjusted to set the minimum height of calipers 52 above base 10. Generally screw 54 is adjusted to position the end of calipers 52 4–6 cm above base 10.

Weight arm 48 is fixed in horizontal position on rod 46 by two pins 60 and 62 but can still rotate about the rod. At the end of weight member 48, there is a relatively heavy metal rod 64 with a soft rubber tip 66. The rubber tip rests on top of ribbon passing over arm 22 to hold the ribbon temporarily in position.

A second horizontal rod 68, also supported between vertical members 12 and 14, provides a stop against which arms 48 and 50 can be positioned when not in use, as shown in FIG. 2.

The apparatus may be made out of a variety of materials. The embodiment shown was constructed primarily of wood, but it is expected that plastic will be preferred for volume production.

OPERATION

Figure 6:
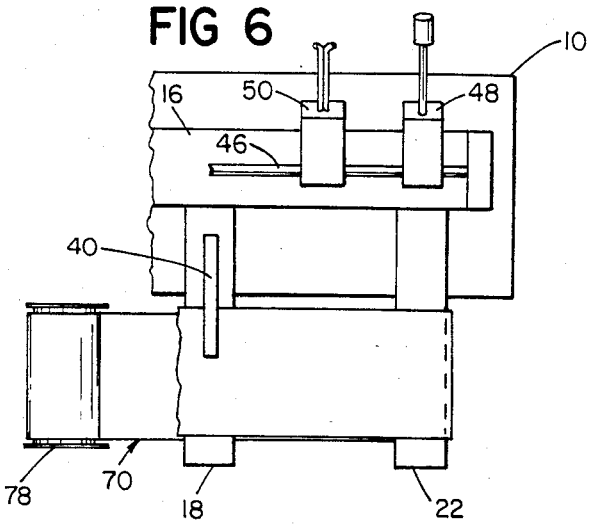

Referring to FIG. 5, arm 18 is fixed in place at a desired distance from arm 22. Holding arm 52 and weight arm 48 are placed in their upright positions, shown in dashed lines in FIG. 2, and holding arm 52 is placed centrally between arms 18 and 22. Ribbon 70, from roll 78, is inserted under spring clip 40 on arm 18, with sheen side upwards, wound around arm 22 and then, as shown in FIG. 6, wound back around arm 18. This process may be repeated as many times as is desired. Preferably from 3 to 6 loops of ribbon are wound around the arms. As the sheen side always faces outwards, all loops of the bow (FIG. 3) are shiny, and no material is wasted. As loops of ribbon are formed around the arms, spring 20 may provide tension on the loops.

Figure 7:
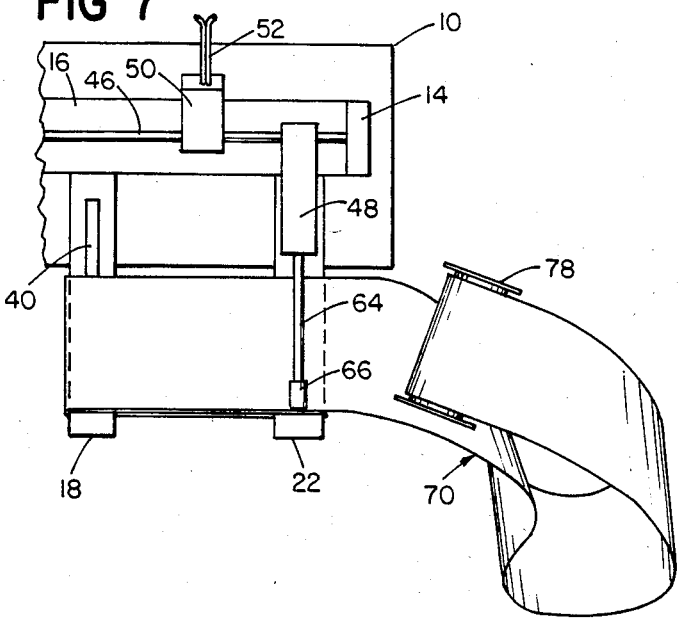
Figure 8:
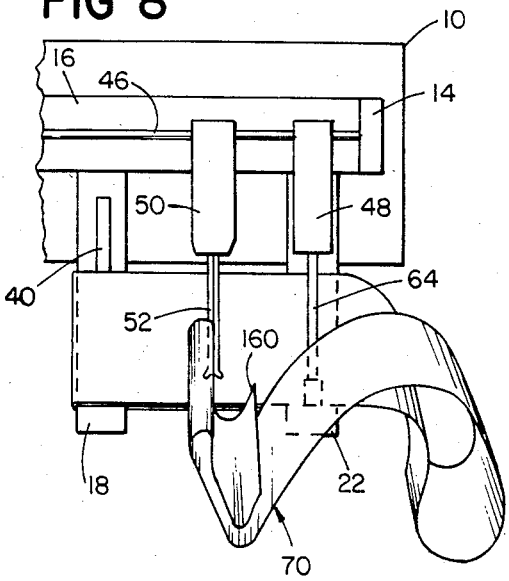
Figure 11:
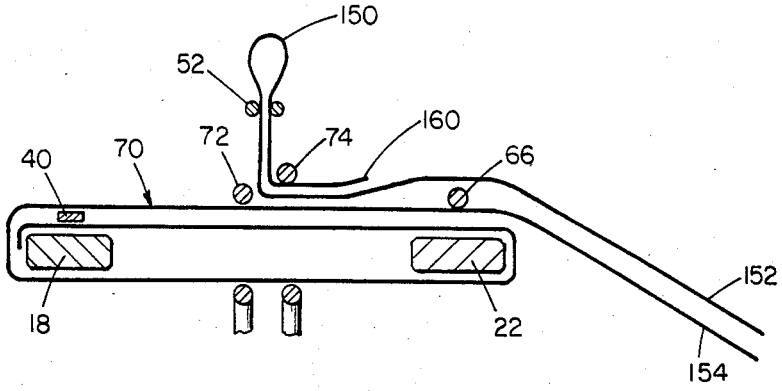

After sufficient loops of ribbon have been wound, weight 66 is brought down to rest (FIG. 7) upon the upper layer of ribbon 70 to hold it in place. Ribbon 70 is then extended a desired length to form a tail, preferably 60–200 cm, and folded back on itself. The ribbon is cut at the desired length and the end 160 of the ribbon (FIG. 8) is again folded back on itself, for a distance of approximately of 20–40 cm, to form a finger loop 150, and placed between the holder pins 52 of holder 50, which has now been brought down to rest above the ribbon layers (FIGS. 8 and 11). It is important that the end of ribbon 160 is extended away from holder 50, and that the finger loop 150 is held at its base.

Figure 9:
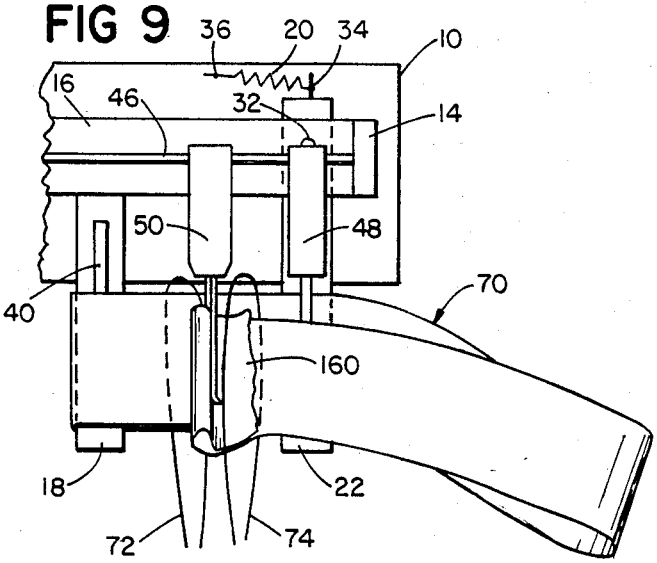
Figure 10:
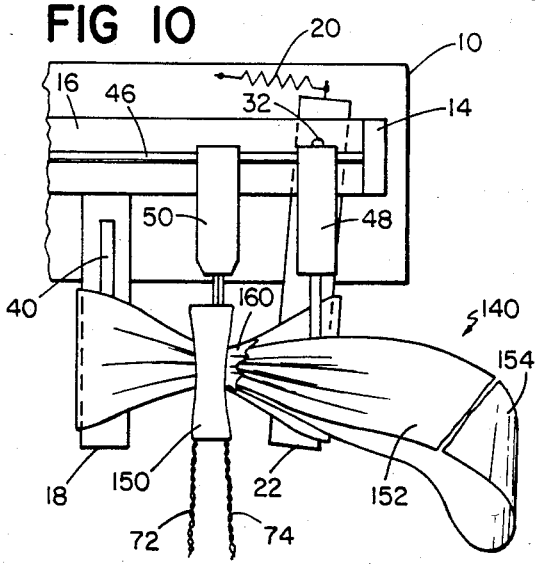
Figure 12:
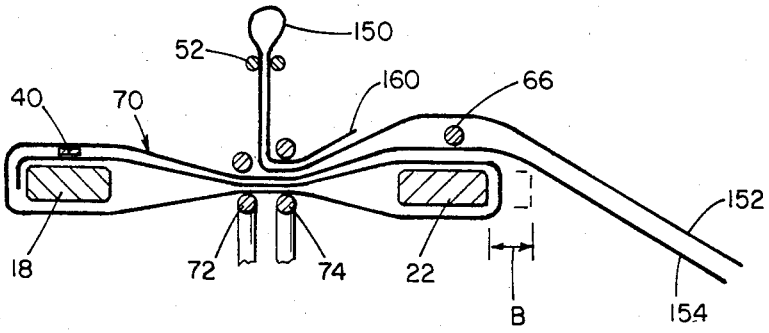

In the next step in the process (FIG. 9), wires 72 and 74 are placed around ribbon 70 such that wire 74 is close to the right side of holder 50 and away from ribbon end 160. Similarly wire 72 is placed on the ribbon, near the left side of holder 50. Wires 72 and 74 are then twisted such that ribbon 70 and finger loop 150 are tightly held, as shown in FIGS. 10 and 11. As wires 72 and 74 are tightened, arm 22 rotates (distance B in FIG. 12) against the load from spring 20. Loop 140 of ribbon 70 is cut at any desired position along its length (FIGS. 10 and 12) to form two free ends 152, 154. Note that the finger loop 150, held in holder 50 by wires 52, forms one loop of the final bow. The bow may then be removed from the apparatus, by pulling it off the arms, and the layers of ribbon adjusted to form an attractive series of loops (FIG. 3).

Referring to FIG. 4, the bow shown in FIG. 3 is readily attached to a wreath or bouquet using wires 72 and 74.

OTHER EMBODIMENTS

Figure 13:
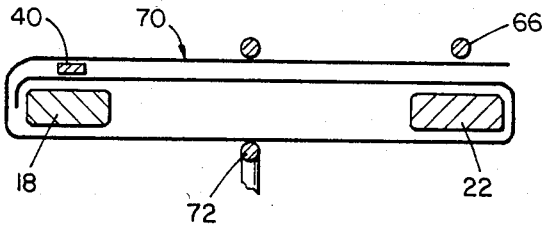
Figure 14:
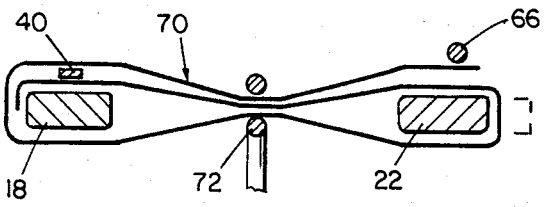

Other embodiments are within the following claims. For example, a simpler bow may be formed without the use of holding arm 50. As illustrated in FIGS. 13 and 14, loops of ribbon are formed around arms 18 and 22, and a single wire 72 is tightened around the center of the loops to form a bow lacking finger loop 150 and tails 152 and 154. Also, a single wire may be used to tie the bow of FIG. 3; preferably this wire is positioned to hold the free end of the ribbon and thus prevent the bow from unwinding. Almost any size of ribbon may be used on the apparatus to make almost any size of bow desired. Other means of tying the bow together may also be used, such as string, staples, or glue.

I claim:

1. Apparatus for winding bows from ribbon , comprising a base, first and second arms about which said ribbon may be wound in a plurality of loops, said arms being supported on said base, a rotatable joint for supporting said second arm on said base so that it is capable of rotation toward said first arm, spring means for resisting rotation of said second arm toward said first arm, said rotatable joint and spring means being capable of permitting said second arm to rotate toward said first arm sufficiently to allow said loops of ribbon to be drawn together midway between said arm in forming a bow

2. The apparatus of claim 1 further comprising a spring-tensioned clip on the surface of one said arm for holding an end of said ribbon.

3. The apparatus of claim 2 wherein said apparatus further comprises a weight arm supported on said base so as to be capable of movement downwardly onto the top of one said arm, after said loops have been wound, to hold an end of said ribbon in place, a holding arm supported on said base so as to be capable of movement into position overhead said loop of ribbon, said holding arm comprising means for holding a loop of ribbon in said overhead position, said holding arm also being capable of movement into position midway between said first and second arms and immediately above the midpoint of said loops so as to hold a loop of ribbon in a position where it can be secured at said midpoint to said loops wound around said arm, wherein said first arm is supported on said base so as to be incapable of rotation, wherein means are provided for supporting at least one of said arms at a plurality of positions along said base so that the separation between said arms, and thereby the width of said loops, may be varied.

4. The apparatus of claim 1 further comprising a weight arm supported on said base so as to be capable of movement downwardly onto the top of one said arm, after said loops have been wound, to hold an end of said ribbon in place.

5. The apparatus of claim 4 further comprising means for rotatably supporting said weight arm so that said arm may be rotated out of proximity to said loops of ribbon when not needed.

6. The apparatus of claim 1 further comprising a holding arm supported on said base so as to be capable of movement into position overhead said loops of ribbon, said holding arm comprising means for holding a loop of ribbon in said overhead position.

7. The apparatus of claim 6 further comprising means for rotatably supporting said holding arm so that said arm may be rotated out of proximity to said loops of ribbon when not needed.

8. The apparatus of claim 6 wherein said holding arm is supported on said base so as to be capable of movement into position midway between said first and second arms and immediately above the midpoint of said loops so as to hold a loop of ribbon in a position where it can be secured at said midpoint to said loops wound around said arm.

9. The apparatus of claim 1 wherein said first arm is supported on said base so as to be incapable of rotation.

10. The apparatus of claim 1 wherein means are provided for supporting at least one of said arms at a plurality of positions along said base so that the separation between said arms, and thereby the width of said loops, may be varied.

11. The apparatus of claim 1 wherein said first and second arms are at least 100 cm long and supported at only one end, to permit use of a variety of widths of ribbon.

12. Apparatus for winding bows from ribbon, comprising a base, first and second arms about which said ribbon may be wound in a plurality of loops, said arms being supported on said base, and a holding arm supported on said base so as to be capable of movement into position overhead said loops of ribbon, said holding arm comprising means for holding a loop of ribbon in said overhead position.

13. The apparatus of claim 12 wherein said holding arm is supported on said base so as to be capable of movement into position midway between said first and second arms and immediately above the midpoint of said loops so as to hold a loop of ribbon in a position where it can be secured at said midpoint to said loops wound around said arm.

14. The apparatus of claim 13 wherein said means for holding said loop of ribbon is a pair of calipers extending transversely to said ribbon, said calipers being adapted to receive a said loop of ribbon by sliding the loop between the calipers.

15. The apparatus of claim 12 further comprising means for rotabably supporting said holding arm so that said arm may be rotated out of proximity to said loops of ribbon.

16. A method of winding a bow from ribbon, comprising the steps of:

winding the ribbon around a pair of arms to form a plurality of wound loops of ribbon, cutting said ribbon at a distance from said wound loops to form a free end of ribbon, folding a portion of said free end of ribbon back on itself to form a first (or finger) loop, inserting said first loop into a holder positioned between said arms above said wound loops, thereby forming a second loop from the remainder of said free end not a part of said first loop, securing said first loop and wound loops together, and cutting said second loop to form two free ends of ribbon which extend from the finished bow.

17. The method of claim 16 wherein said loops are secured by twisting at least one wire around them.

18. The method of claim 17 wherein said loops are secured by twisting one wire around each side of said first loop.

19. The method of claim 16 wherein said ribbon is not notched where said loops are secured together.

* * * * *